US005447356A

United States Patent [19]

Snijders

[11] Patent Number: 5,447,356

[45] Date of Patent: Sep. 5, 1995

[54] CHAIR FOR DISABLED PERSONS

[75] Inventor: Christiaan J. Snijders, PT Wassenaar, Netherlands

[73] Assignee: B.V. Linido, TP Pijnacker, Netherlands

[21] Appl. No.: 940,873

[22] PCT Filed: Apr. 26, 1991

[86] PCT No.: PCT/NL91/00070

§ 371 Date: Oct. 30, 1992

§ 102(e) Date: Oct. 30, 1992

[87] PCT Pub. No.: WO91/16874

PCT Pub. Date: Nov. 14, 1991

[30] Foreign Application Priority Data

May 1, 1990 [NL] Netherlands ..... 9001040

[51] Int. Cl.[6] ..... A47C 1/024

[52] U.S. Cl. ..... 297/284.3; 297/486; 297/487; 297/464

[58] Field of Search ..... 297/284 B, 130, 464, 297/466, 487, 488, 486

[56] References Cited

U.S. PATENT DOCUMENTS

| | | | |
|---|---|---|---|
| 2,136,852 | 11/1938 | Knauth | 297/486 X |
| 3,761,126 | 9/1973 | Mulholland . | |
| 3,950,026 | 4/1976 | Van Seenus | 297/464 X |
| 4,234,228 | 11/1980 | Flamm | 297/486 X |
| 4,647,066 | 3/1987 | Walton | 297/464 X |
| 4,813,746 | 3/1989 | Mulholland . | |

FOREIGN PATENT DOCUMENTS

| | | | |
|---|---|---|---|
| 265782 | 5/1988 | European Pat. Off. . | |
| 2651843 | 5/1978 | Germany . | |
| 6905431 | 10/1970 | Netherlands . | |
| 7113766 | 4/1972 | Netherlands . | |
| 1301595 | 12/1972 | United Kingdom | 297/464 |
| 2067394 | 7/1981 | United Kingdom . | |

*Primary Examiner*—Michael F. Trettel
*Attorney, Agent, or Firm*—Beveridge, DeGrandi, Weilacher & Young

[57] ABSTRACT

A chair for disabled persons has a supporting frame, a seat adjustably connected to the supporting frame by a hinge, and a back adjustably connected by a hinge to the rear of the seat. The seat has a front section which lies beneath and supports the upper legs of an occupant, and a rear section which lies beneath and supports the pelvis of an occupant. The front and rear sections can be fixed and adjusted independently of each other due to a hinge which is parallel to the hinge at the rear of the seat.

13 Claims, 4 Drawing Sheets

CHAIR FOR DISABLED PERSONS

The present invention relates to a chair for the disabled, comprising at least a seat, a back and a supporting frame, the seat being adjustably connected to the back by means of a hinge at the rear end of the seat, and the supporting frame being adjustably connected to the seat by means of a hinge, the axes of the said hinges being parallel to one another.

Seats of this type are generally known. When used, the seat usually assumes a substantially horizontal position, whereas the back, being hingably connected to a rear end of the seat, will form an obtuse angle to the seat. The hinge connecting the supporting frame to the seat and the back has been positioned in line with the hinge connecting the back and the seat. If no further measures are taken, the weight of the reclined upper part of the body will cause the pelvis to shift forward and to be tilted backwards, on account of which the upper part of the body is substantially supported by the coccyx and no longer by the tuberosities of the ischia. This sacral sitting position will moreover result in an undue load on the spinal column, and is even more likely to occur if the seat is forwardly declined. Such an oblique positioning of the seat and back, however, may be desirable with spastics in order to suppress flexion spasms or stretching spasms, for which purpose the angle confined by the upper legs and the back should be considerably larger or smaller than 90°, e.g. 120° or 60°, respectively. It is known to fix the pelvis in its position by means of lap belts or abduction blocks. However, these do not establish a desirable sitting position, i.e. a position in which the upper part of the body is substantially supported by the tuberosities of the ischia, as a reclined back tends to tilt the pelvis backwards, and an obliquely adjusted seat yields a support of the upper part of the body substantially by the lap belts and/or the abduction blocks. Apart from that, a reclined back forces the disabled into a reclined and therefore passive posture.

The present invention aims to remove these drawbacks and for that purpose according to the invention a chair for the disabled is provided, said chair being characterized in that the seat is divided into a front section destined to support the upper legs, and a rear section destined to support the pelvis, and in that the front and the rear section can each be fixed and adjusted, independently of one another, by means of a hinge that is parallel to the hinge at the rear end of the seat.

After the pelvic section of the seat has been adjusted in order to obtain the desired sitting position, it is thus possible that the desired hip angle can be adjusted independently thereof by adjusting the upper leg section of the seat.

According to a further embodiment of the invention, the section of the seat destined for supporting the pelvis comprises a rear portion extending up to a point at level with the lumbar region, preferably at the top edge of the sacrum of the lumbar spinal column, at which position the hinge is located for adjustably and fixedly connecting the back to the seat. This allows for adjustment of the back without affecting the desired positioning of the pelvis and thus the desired sitting position, while moreover the rear portion of the pelvic section of the seat provides further support for the pelvis.

Further advantages and other characteristics of the chair for the disabled according to the invention will appear from the following description of a number of embodiments, in which reference is made to the drawing in which.

Figure 1:
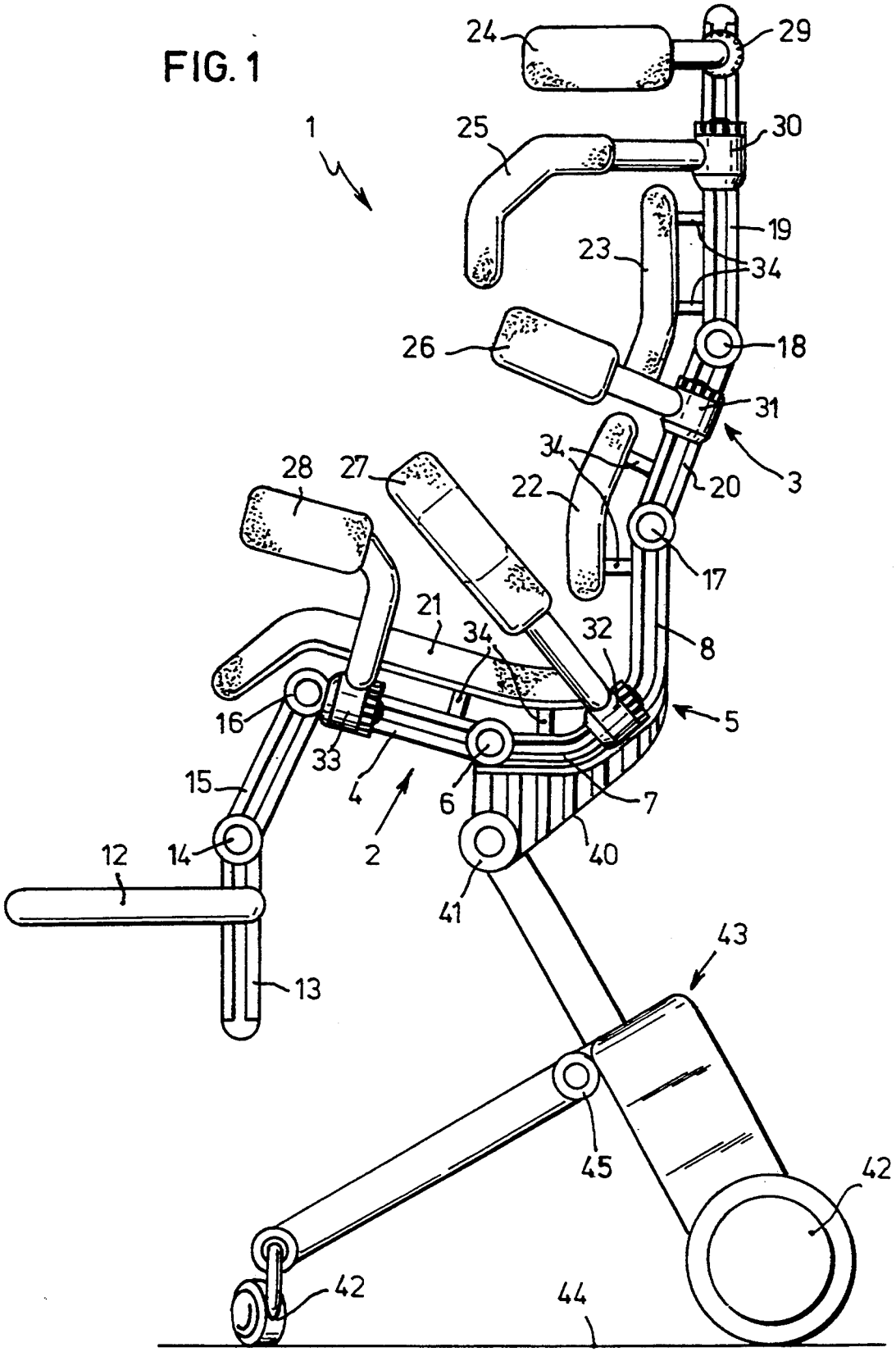
FIG. 1 shows a side view of a first embodiment of the chair for the disabled according to the invention.
Figure 4:
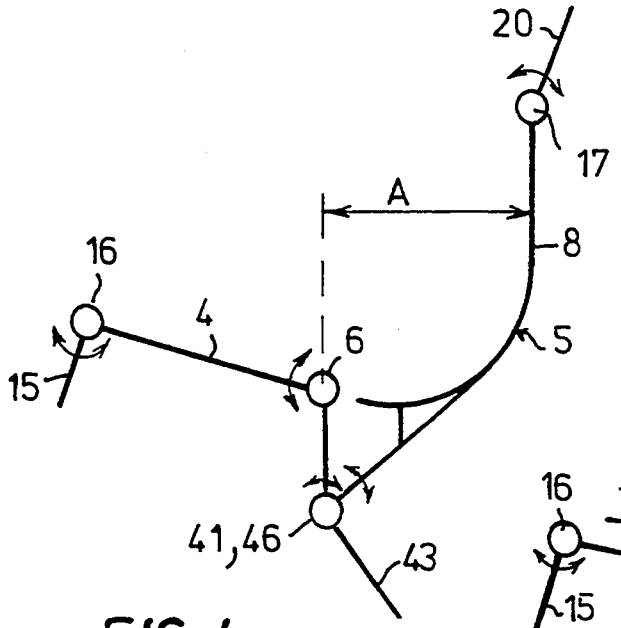
FIG. 4 shows a schematic side view of a first variant of the chair for the disabled according to FIG. 1.
Figure 4A:
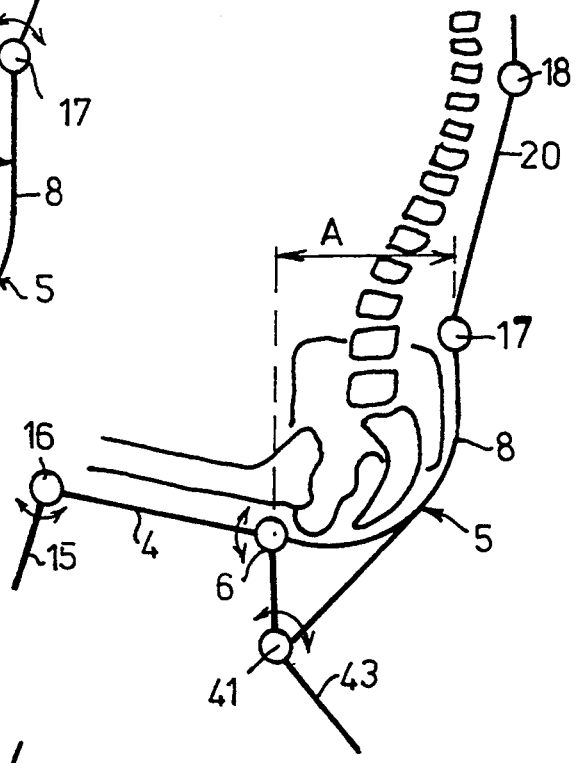
Figure 5:
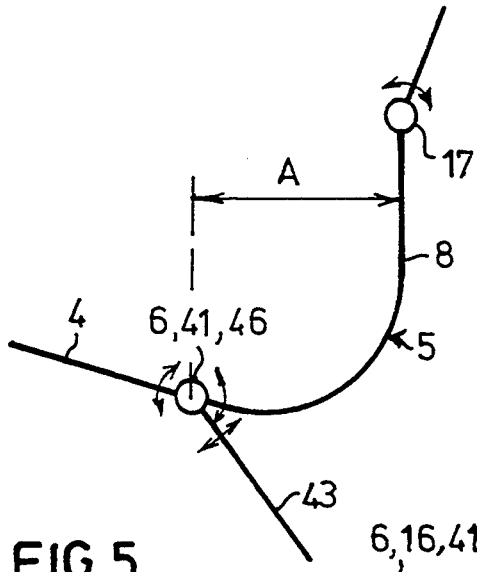
Figure 6:
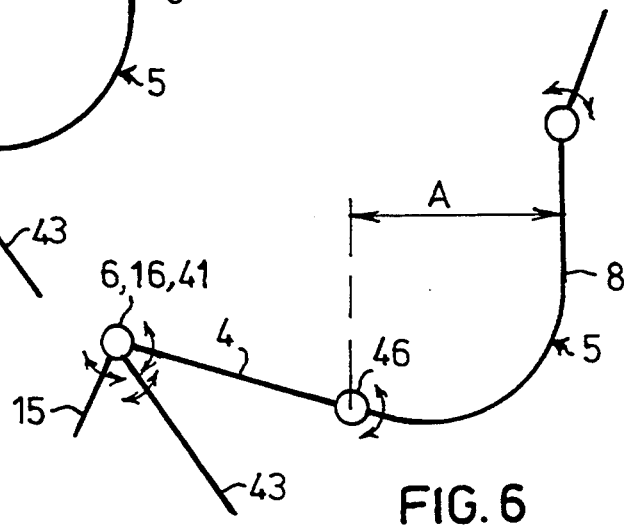

FIG. 4*a*, for comparison's sake, shows a schematic side view of the chair according to FIG. 1;

FIG. 5 shows a schematic side view of a second variant of the chair for the disabled according to FIG. 1; and FIG. 6 shows a schematic side view of a third variant of the chair for the disabled according to FIG. 1.

FIG. 1 shows a first embodiment of the chair for the disabled according to the invention. The chair 1 comprises a seat 2, a back 3 and a supporting frame 43. The seat 2 comprises a section 4 destined to support the upper legs and a section 5 destined to support the pelvis. The upper legs section 4 and the pelvic section 5 are hingably interconnected by means of a hinge 6. The pelvic section 5 of the seat 2 comprises a substantially horizontal foremost section 7 and a substantially vertical rearmost section 8 connected thereto, both parts having been devised in a manner suitable for supporting the pelvis by means of support faces 21 and 22 which will be described hereinafter. When the seat is being used, the tuberosities of the ischia are therefore supported by the pelvic section 5, and particularly the foremost section 7 thereof. The pelvic section 5 is mounted on a supporting frame 43 provided with wheels 42 by means of a connecting piece 40 and a hinge 41. The hinge 41 allows separate adjustment of the pelvic section 5, preferably to such an extent that the foremost section 7 defines a small angle, preferably approx. 5° to the horizontal, in this case being the floor 44, so that the pelvic section is slightly declined from the hinge 6 onwards.

Moreover, the hinge 41 allows the chair as a whole to be reclined at a larger angle, e.g. 45°, with respect to the supporting frame 43, so that a sleeping or resting position is obtained.

The pelvic section 5 of the seat 2 is preferably mounted so that it can be detached from the connecting piece 40, so that the chair 1 without its supporting frame 43 can easily be transported in a car on the front or back seat in a ready-to-use condition. As the pelvic section 5 is practically flat at the bottom, there is no risk of possible damage to the car seat. The supporting frame 43 is collapsible with the aid of a hinge 45 and can therefore easily be separately transported.

According to the invention the upper leg section 4 can be adjusted by means of the hinge 6 independently of the position of the pelvic section 5, so that practically any angle required for suppressing stretching or flexion spasms can be attained without affecting the position of the pelvis, i.e. the proper sitting position. In the present context, the term hip angle refers to the angle confined by the upper legs sections 4 and the foremost section 7 of the pelvic section 5.

In order to prevent the weight of the lower legs and feet to put a load on the pelvis, a height-adjustable footrest 12 is provided, connected to a guide 13 which is connected by means of a hinge 14, a connecting piece 15 and a hinge 16 to the seat 2. The hinges 14 and 16 and the height of the footrest 12 allow for adjustment to the length of the upper and/or lower legs.

The back 3 is hingably connected by means of a hinge 17 to the rearmost section 8 of the pelvic section 5. The rearmost section 8 of the pelvic section 5 extends up to a position at level with the lumbar region, preferably at the top edge of the sacrum of the lumbar spinal column. The angle confined by the rearmost portion 8 of the pelvic section 5 and a lowermost portion 20 of the back will be indicated by the term lumbar angle. In this way, independently of the position of the pelvic section 5 of the seat 2, the lumbar angle can be adjusted by means of hinge 17. In order to prevent the entire back 3 from being steeply reclined when the lumbar angle is great, a further hinge 18 is provide by means of which the uppermost section 19 of the back 3 can be adjusted with respect to the lowermost section 20. The hinge 18 is preferably located at level with the kyphotic maximum of the spinal column, in order to obtain an optimum adaptation to the spinal column for a given position of the lowermost section 20 of back 3 as determined by the lumbar angle. Apart from the fact that it allows an active posture, the adjustable uppermost section 19 of the back 3 also allows a suitable support for the head by means of a head support 24. Parts 13, 15, 4, 7, 8, 19 and 20, together constituting the framework of the chair, are preferably made of metal.

The actual support of the upper legs, the pelvis and back of the disabled is provided by the support faces 21 and 22 and a support face 23, respectively. If required for keeping a spastic in the desired position, shoulder supports 25, flank supports 26 and hip supports 27 may be provided. For an abduction of the legs, supports 28 are provided. The supports or padded means 24, 25, 26, 27 and 28 are each preferably a metal tube coated with a padding. The supports 24, 25, 26, 27 and 28 are connected by means of hinges 29, 30, 31, 32 and 33, respectively, to the framework of the chair 1.

The hinges 29, 30, 31, 32 and 33 are preferably devised so that the respective supports can be swivelled away from a fixed, adjustable position and back to that same position. The support faces 21, 22 and 23 and the coating of the supports or padded means 24, 25, 26, 27 and 28 may be made of a resilient plastic foam, e.g. soft polyurethane. The support faces 21, 22 and 23 may have been reinforced.

As indicated in FIG. 1, the support faces 21, 22 and 23 at least extend to over the pertaining hinges 16, 6, 17 and 18, and they are spaced from the framework of the chair by means of spacers 34, thus preventing sharp bends when supporting the body. The support faces 21, 22 and 23 are furthermore preferably mounted on either side of the pertaining hinges, by means of the spacers 34, so that the support faces are able to accurately follow the adjustment of the hinges 16, 6, 17 and 18. FIG. 1 shows this mounting for hinges 6 and 17. The slim framework formed by parts 13, 15, 4, 7, 8, 19 and 20 renders the chair relatively light-weighted and modest in size, making it practical to use.

Figure 2:
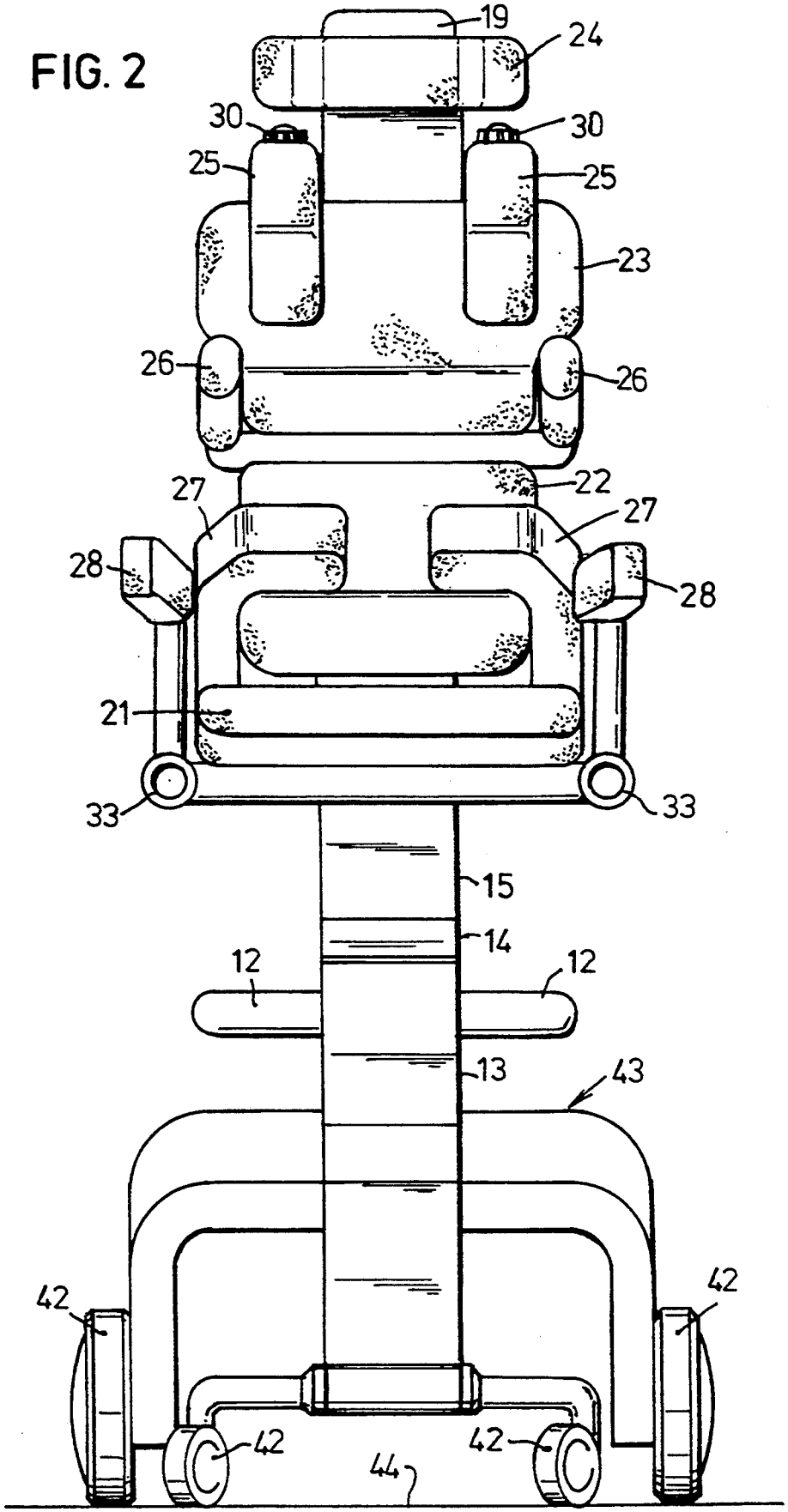
FIG. 2 shows a front view of the chair for the disabled according to FIG. 1.

FIG. 2 is a front view of the chair for the disabled according to FIG. 1, in which corresponding parts have been indicated by the same reference numerals.

Figure 3:
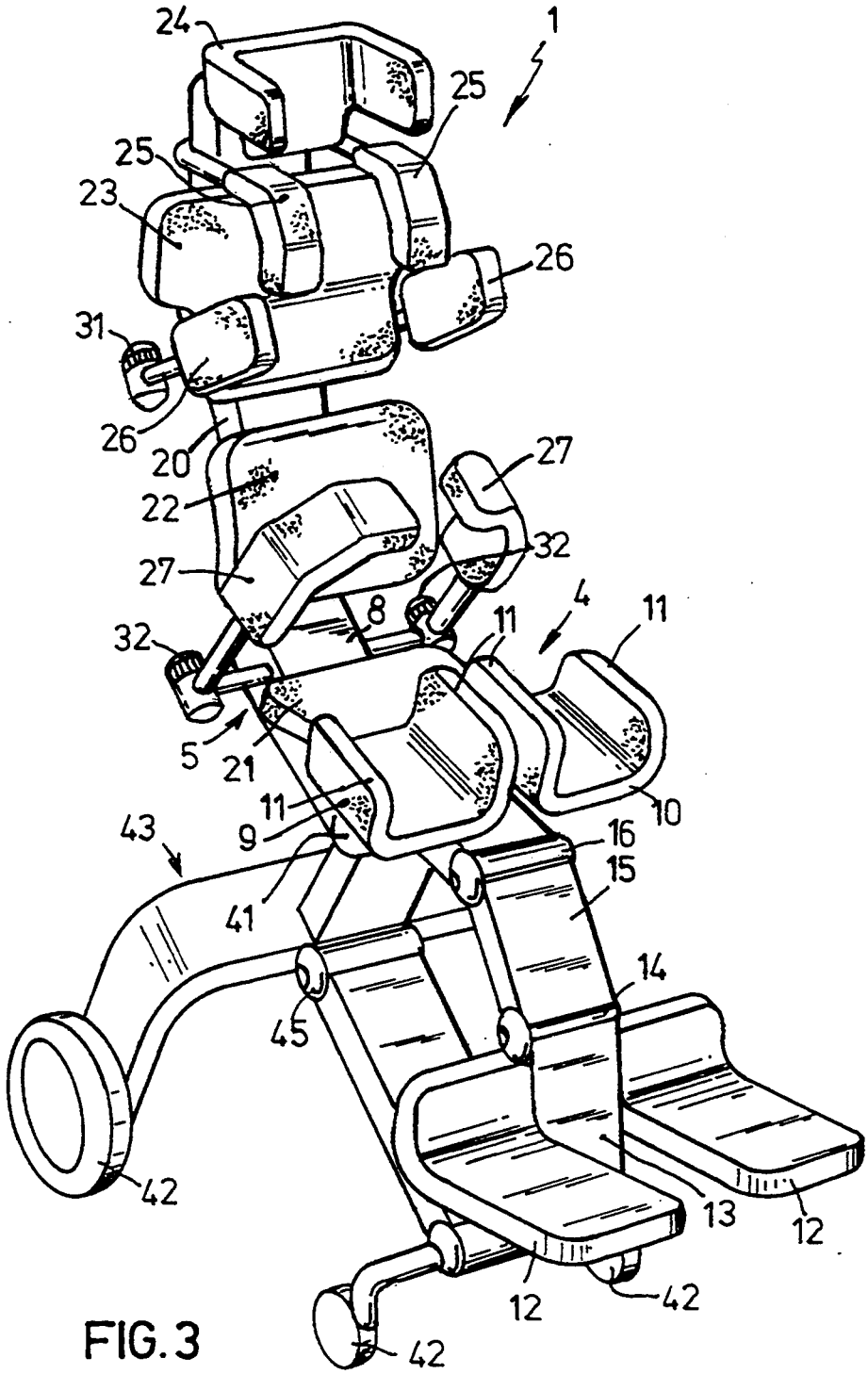
FIG. 3 shows a view, in perspective, of a second embodiment of a chair for the disabled according to the invention.

FIG. 3 represents a second embodiment of the chair for the disabled. In as far as they are represented, the parts that correspond to those of the embodiments according to FIGS. 1 and 2 have been indicated by the same reference numerals. In this embodiment the upper leg section 4 consists of two halves 9 and 10, each being hingeable separately with respect to the pelvic section 5 in order to separately set a right and a left hip angle. The upstanding edges 11 formed at the halves 9 and 10 allow the legs to be abducted.

FIGS. 4 to 6 each schematically show another variant of the chair for the disabled according to FIG. 1. FIG. 4*a*, for comparison's sake, shows the chair according to FIG. 1 in the same schematic outline. In FIGS. 4, 4*a* and 5, A is used to indicate the distance between the hinging point 6 and the front of the substantially vertical rearmost section 8 of the pelvic section 5. If there is a support face 22, vide FIG. 1, the distance A is measured up to the front side of the support face 22. Thus the distance A will always correspond to the distance up to the patient's back. In FIG. 6, distance A is defined from the hinge 46 to the rearmost section 8. In the field of application of the chair for the disabled according to the invention, the extent of distance A is an important parameter. The distance A is preferably adjustable and equal to a value within the range of 4 to 15 cm, preferably 4 to 12 cm. For adjusting the distance A adjustment means may have been provided in the form of height-adjustable spacers 34 (vide FIG. 1).

In FIG. 4, a hinge 46 allowing the pelvic or rear section 5 to be adjusted and fixed is in line with the hinge 41 for adjustably connecting the support 43 to the seat 2. Contrary to the embodiment according to FIG. 4*a*, the hinge 6 does not connect the pelvic section 5 to the upper legs section 4 any longer. This disconnection allows for distance A to be set by a displacement of the hinge 6 with respect to the pelvic section 5. As in FIGS. 1 and 4*a*, the hinge 6 is located above the hinge 41.

In FIG. 5 all three hinges 6, 41 and 46 are aligned.

In FIG. 6, the hinge 6 that allows the upper legs or front section 4 of the seat to be adjusted and fixed is in line with the hinge 41 for adjustably connecting and support to the seat. Hinge 41 is then located at the front end of the front section 41 destined to support the upper legs. The hinges 6 and 41 are in line with the hinge 16.

It is remarked that many alterations to the above-described embodiments of the chair for the disabled according to the invention can be made by any expert without deviating from the scope of the invention. It will e.g. be clear that the support faces 24, 25, 26, 27 and 28, or at least a number thereof, can be omitted for the less severely disabled, whose spasms do not require the presence of these supports. In that case the chair for the disabled according to the invention is even more modest in size and appearance with respect to the disabled person.

I claim:

1. Chair for the disabled, comprising at least a seat, a back and a supporting frame, the seat being adjustably connected to the back by means of a hinge at the rear end of the seat, and the supporting frame being adjustably connected to the seat by means of a hinge, the axes of the said hinges being parallel to one another, wherein the seat is divided into a front section destined to lie beneath and support the upper legs and a rear section destined to lie beneath and support the pelvis, and wherein the front and the rear section can each be fixed and adjusted independently of one another by means of a hinge that is parallel to the hinge at the rear end of the seat.

2. Chair for the disabled according to claim 1, wherein the hinge which allows the rear section to be adjusted and fixed is in line with the hinge for adjustably connecting the supporting frame to the seat.

3. Chair for the disabled according to claim 1, wherein the hinge which allows the front section to be adjusted and fixed is in line with the hinge for adjustably connecting the supporting frame to the seat.

4. Chair for the disabled according to claim 1, wherein the hinge which allows the front section to be adjusted and fixed is located above the hinge for adjustably connecting the supporting frame to the seat.

5. Chair for the disabled according to claim 1, wherein the distance (A) from the hinge between the front and the rear section to the front of the back ranges from 4 to 15 cm.

6. Chair for the disabled according to claim 5, wherein adjustment means are provided for adjusting the distance (A).

7. Chair for the disabled according to claim 1, wherein the section of the seat destined for supporting the pelvis comprises a rearmost section extending up to a position at level with the lumbar region, preferably at the top edge of the sacrum of the lumbar spinal column, at which position the hinge is located for adjustably and fixedly connecting the back to the seat.

8. Chair for the disabled according to claim 7, wherein the back is also hingable at the point of the kyphotic maximum of the spinal column.

9. Chair for the disabled according to claim 1, wherein the section of the seat which is destined to support the upper legs comprises two halves, each being separately and adjustably connected to the section of the seat destined to support the pelvis region.

10. Chair for the disabled according to claim 1, wherein the section of the seat destined for supporting the upper legs is hingably connected to a footrest by means of at least one hinge.

11. Chair for the disabled, comprising at least a seat, a back and a supporting frame, the seat being adjustably connected to the back by means of a hinge at the rear end of the seat, and the supporting frame being adjustably connected to the seat by means of a hinge, the axes of the said hinges being parallel to one another, wherein the seat is divided into a front section destined to lie beneath and support the upper legs and a rear section destined to lie beneath and support the pelvis, and wherein the front and the rear section can each be fixed and adjusted independently of one another by means of a hinge that is parallel to the hinge at the rear end of the seat, said rear section of the seat having a foremost section which is positioned at a downward slope towards the rear with respect to the horizontal, at a small angle of about 5°.

12. Chair for the disabled, comprising at least a seat, a back and a supporting frame, the seat being adjustably connected to the back by means of a hinge at the rear end of the seat, and the supporting frame being adjustably connected to the seat by means of a hinge, the axes of the said hinges being parallel to one another, wherein the seat is divided into a front section destined to lie beneath and support the upper legs and a rear section destined to lie beneath and support the pelvis, and wherein the front and the rear section can each be fixed and adjusted independently of one another by means of a hinge that is parallel to the hinge at the rear end of the seat, and support members in the shape of a number of support faces extending at least over a hinge.

13. Chair for the disabled according to claim 12, wherein a number of the support faces is connected on either side of a hinge by means of spacers.

* * * * *